US005170732A

United States Patent [19]

Gordon

[11] Patent Number: 5,170,732

[45] Date of Patent: Dec. 15, 1992

[54] SEWING MACHINE BOBBIN

[76] Inventor: Herbert G. Gordon, 724 E. St. George Ave., Linden, N.J. 07036

[21] Appl. No.: 757,025

[22] Filed: Sep. 9, 1991

[51] Int. Cl.[5] ..... D05B 71/02; B65H 55/00; F01M 9/00

[52] U.S. Cl. ..... 112/256; 242/159; 242/170; 184/6.15; 112/262.1

[58] Field of Search ..... 112/256, 43, 262.1; 242/159, 168, 169, 170, 171; 184/6.15

[56] References Cited

U.S. PATENT DOCUMENTS 2,291,098 7/1942 Myers ..... 112/256
2,346,139 6/1944 Myers ..... 112/256
2,857,981 10/1958 Koike ..... 112/256 X

*Primary Examiner*—Werner H. Schroeder
*Assistant Examiner*—Paul C. Lewis
*Attorney, Agent, or Firm*—Lewis H. Eslinger; Donald S. Dowden

[57] ABSTRACT

A bobbin comprises a hollow hub adapted to cooperate with a latch and post on a bobbin casing housed in a sewing machine. The latch and post enter the hub and guide the bobbin into place in the sewing machine. Thread previously wound around the hub is adapted for paying out for use in the sewing machine. Before the bobbin is inserted for use in the sewing machine, a membrane is placed across the hub at one axial end to seal that end and form a reservoir within the hub, and a lubricant such as sewing machine oil is added to the reservoir. Another membrane is placed across the hub at the other axial end of the hub to seal that end and completely seal the oil within the reservoir. When the bobbin is inserted into the bobbin casing, the latch punctures both membranes, the post guides the bobbin so that it is properly seated within the bobbin casing, and the sewing machine oil contained in the reservoir drains out and lubricates the sewing machine.

13 Claims, 1 Drawing Sheet

SEWING MACHINE BOBBIN

BACKGROUND OF THE INVENTION

1. Field of the Invention

This invention relates to a bobbin for use in a sewing machine and more particularly to a novel and highly effective bobbin the use of which ensures that the sewing machine is always properly lubricated.

2. Description of the Prior Art

Sewing machines have been known for more than a century. Properly maintained, a sewing machine will last for many years. A major part of the maintenance of a sewing machine involves periodic lubrication with a good-quality sewing machine oil. Overlubrication, however, is unnecessary and even harmful, since an excess of oil may attract airborne dust, which is ubiquitous in an indoor environment, especially when fabrics are being processed and otherwise handled. Overlubricated parts may eventually become sticky or gummy.

Sewing machines intended for industry, for example for use in making seat covers for cars, are normally given heavy usage. Because of heavy production schedules, there is a tendency for a user of an industrial sewing machine to meet output quotas and deadlines even at the cost of neglecting the prescribed oiling of the machine.

Sewing machines intended for the home tend to be put to much lighter use. The prescribed oilings of a home-type sewing machine are normally at such infrequent intervals that a user of the sewing machine can easily forget to apply oil at a scheduled interval and moreover may lose track of the last time oil was applied.

The frequency of oiling of any sewing machine, whether intended for industrial use or home use, should be commensurate with the amount of work done by the machine. That is, the heavier the usage of the sewing machine the more frequently it should be lubricated. Often a person responsible for oiling a sewing machine will not recall clearly or know in the first instance the usage to which the machine has been subjected, particularly if more than one person has used the machine. The machine may be oiled excessively if each of several users assumes the responsibility of applying oil or insufficiently if each user assumes that the oiling has been done by another user.

Various expedients may be employed by users of sewing machines in order to establish a proper oiling schedule. For example, every time a machine is oiled, the person adding the oil may apply a gummed label to the machine indicating the date (if a home-type machine) or the date and time of day or work shift (if an industrial-type machine) of the oiling. Most users, however, are not sufficiently disciplined to do this on a regular basis, and if a gummed label is applied, users of the machine are likely to become accustomed to its presence and fail to pay much attention to it. Moreover, the time of oiling is not the sole criterion for determining when the next oiling is due; the frequency of use of the machine should also be taken into account, and of course a gummed label applied to the machine and bearing only the time of last oiling does not supply this information.

It might be thought that a sort of clock similar to those used to record engine time on an aircraft or a sort of odometer similar to those used to record mileage on cars and trucks should be incorporated in a sewing machine to provide information regarding the usage of the sewing machine so that a user of the sewing machine can determine when oiling is required, much as a user of an airplane, car or truck can determine when a change of oil is necessary by referring to the engine clock or odometer. However, airplanes, cars and trucks are relatively expensive, so that the incorporation of relatively expensive instrumentation is warranted. A sewing machine is much less expensive, and the incorporation of expensive instrumentation to determine the frequency of oiling is much more difficult to justify.

It is believed that no ideal solution to the problems discussed above is found in the prior art.

OBJECTS AND SUMMARY OF THE INVENTION

An object of the invention is to remedy the problems of the prior art outlined above. In particular, an object of the invention is to provide an oiling device and method whereby a sewing machine is automatically lubricated in a manner proportioned to the usage of the sewing machine. More particularly, an object of the invention is to provide a device and method such that, the heavier the usage of the sewing machine, the more frequently the sewing machine is lubricated. Another object of the invention is to accomplish automatic lubrication of the sewing machine without conscious effort on the part of a user of the machine.

The foregoing and other objects of the invention are attained in the best mode known to the inventor for practicing the invention by providing a bobbin comprising a hollow hub adapted to cooperate with a part on a sewing machine for guiding the bobbin into place in the sewing machine and further adapted to have thread wound therearound, the thread being adapted for paying out for use in the sewing machine. A membrane extends across the hub to form a reservoir within the hub, and a flowable lubricant is contained within the reservoir. When the bobbin is inserted into the sewing machine for use therein, the part punctures the membrane and the lubricant contained in the reservoir drains out and lubricates the sewing machine.

In accordance with an independent aspect of the invention, there is provided a method of automatically lubricating a machine that cooperates with a component that must be changed from time to time. The method comprises the steps of providing an amount of lubricant proportional to the amount of service the component is designed for, incorporating the lubricant in the component, and establishing a relationship between the machine and the component such that, when the component is installed for cooperation with the machine, the lubricant is released to lubricate the machine.

In accordance with another independent aspect of the invention, there is provided a method of automatically lubricating a sewing machine comprising the steps of adding a reservoir formed at least in part of a breakable membrane to a bobbin that supplies a predetermined quantity of bobbin thread for use in a sewing machine and adding to the reservoir a quantity of flowable lubricant proportioned to the predetermined quantity of bobbin thread. The reservoir is positioned relative to the bobbin in such a manner that the bobbin cannot be inserted into the sewing machine for use therein without breaking the membrane. Accordingly, when the bobbin is inserted into the sewing machine for use therein, the membrane is broken and a predetermined quantity of lubricant proportioned to the predetermined quantity of bobbin thread flows out of the reservoir to lubricate the sewing machine.

Preferably, a plurality of bobbins are provided for successive use in the sewing machine, each of the bobbins containing a predetermined quantity of bobbin thread for use in the sewing machine. Each bobbin has a reservoir formed at least in part of a breakable membrane, and there is added to each reservoir a quantity of flowable lubricant proportioned to the predetermined quantity of bobbin thread contained on the bobbin to which such reservoir is added. Each reservoir is positioned relative to its bobbin in such a manner that the bobbin cannot be inserted into the sewing machine without breaking the membrane. When each bobbin is inserted into the sewing machine for use therein, its membrane is broken and a quantity of lubricant proportioned to the predetermined quantity of bobbin thread contained on the bobbin flows out of the reservoir to lubricate the sewing machine. Accordingly, the heavier the usage of the sewing machine, the more quickly the thread on each bobbin is used up, the more frequently the bobbins are changed, and the more frequently the sewing machine is lubricated.

BRIEF DESCRIPTION OF THE DRAWING

A better understanding of the objects, features and advantages of the invention can be gained from a consideration of the following detailed description of the preferred embodiments thereof, in conjunction with the appended figures of the drawing, wherein.

DESCRIPTION OF THE PREFERRED EMBODIMENT

Figure 1:
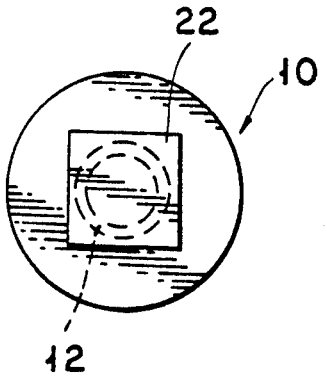
FIG. 1 is a plan view of a bobbin formed with an oil-containing reservoir in accordance with the invention.
Figure 2:
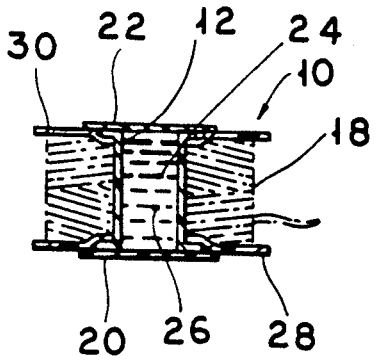
FIG. 2 is a view of the bobbin shown in FIG. 1 sectioned in a plane containing the axis of the bobbin.
Figure 3:
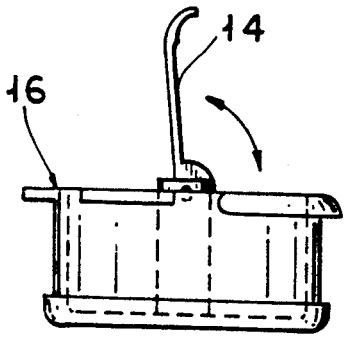
FIG. 3 is a view in elevation of a bobbin casing that houses the bobbin of FIGS. 1 and and is adapted to be housed in a sewing machine in such a manner as to position the bobbin correctly for use in the sewing machine.
Figure 4:
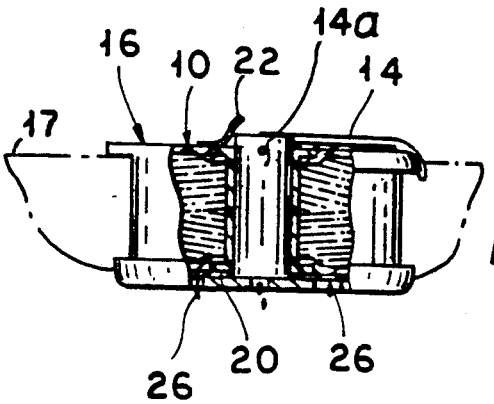
FIG. 4 is a view in elevation, partly broken away, showing the bobbin inserted in the bobbin casing for use in the sewing machine, a latch and post of the bobbin casing having ruptured the bobbin membranes and oil contained in the reservoir of the bobbin flowing out for lubricating the sewing machine.

FIGS. 1 and 2 show a bobbin 10 constructed in accordance with the invention. The bobbin 10 is a component designed to cooperate with a sewing machine, and it comprises a hollow hub 12. The hub 12 is adapted to cooperate with a part such as a latch 14 and post 14*a* as shown in FIGS. 3 and 4 on a bobbin casing 16 for guiding the bobbin 10 into place in a sewing machine shown schematically at 17. The hub 12 is further adapted to have thread 18 wound therearound in a conventional manner, the thread 18 being adapted for paying out for use in the sewing machine 17.

In accordance with the invention, a pair of spaced-apart membranes 20 and 22 extend across the hub 12 at axially opposite ends thereof to form a reservoir 24 within the hub, and a flowable lubricant such as sewing machine oil 26 is contained within the reservoir 24. Accordingly, when the bobbin 10 is inserted into the sewing machine 17, the part comprising the latch 14 and post 14*a* punctures the membranes 20 and 22, and the post 14*a*, which is pivotally joined end-to-end with the latch 14, guides the bobbin 10 to a seated position within the bobbin casing 16. The latch 14 is folded from the position of FIG. 3 to that of FIG. 4 to secure the bobbin 10 within its casing 16. Meanwhile, the oil 26 contained in the reservoir 24 drains out and lubricates the sewing machine 17. The flowable lubricant may be any suitable sewing machine oil.

The bobbin 10 contains a pair of flanges 28 and 30 extending radially outwardly from the hub 12. The flanges 28 and 30 are spaced apart from each other axially along the hub 12 and are adapted to facilitate neatly storing the thread 18 wound around the hub 12. The membranes 20 and 22 are applied respectively to the flanges 28 and 30. Each of the membranes 20 and 22 is made of a plastic that is impervious to oil and suitable for maintaining the oil within the reservoir 24 for an extended period of storage. The membranes 20 and 22 are preferably secured to the bobbin 10 by an adhesive.

In accordance with the lubricating method of the invention, the reservoir 24 is formed at least in part of a breakable membrane 20, 22. The bobbin 10 supplies a predetermined quantity of bobbin thread for use in a sewing machine, and a quantity of oil proportioned to the predetermined quantity of bobbin thread is added to the reservoir 24. The reservoir 24 is positioned relative to the bobbin 10 in such a manner that the bobbin 10 cannot be inserted into the sewing machine 17 for use therein without breaking at least the membrane 20.

Preferably a plurality of bobbins is provided for successive use in the sewing machine 16. Each of the bobbins contains a predetermined quantity of bobbin thread 18 for use in the sewing machine. Each bobbin has a reservoir formed at least in part of a breakable membrane, and to each reservoir is added a quantity of oil proportionate to the predetermined quantity of bobbin thread contained on the bobbin to which the reservoir is added. Accordingly, the heavier the usage of the sewing machine, the more quickly the thread on each bobbin is used up, the more frequently the bobbins must be changed, and the more frequently the sewing machine is lubricated.

The predetermined quantity of bobbin thread 18 on each of the plurality of bobbins may be the same as or different from the predetermined quantity of bobbin thread on another of the plurality of bobbins. Thus, a large bobbin (containing a large amount of thread) will contain more oil than a small bobbin (containing a relatively small quantity of thread).

Thus there is provided in accordance with the invention a novel and highly effective bobbin and method of its employment ensuring that a sewing machine is lubricated on a proper schedule and in particular ensuring that the heavier the usage of the sewing machine, the more frequently it is lubricated. Many modifications of the preferred embodiment of the invention disclosed above will readily occur to those skilled in the art. For example, the amount of thread wound on the bobbin and the amount of oil contained within the reservoir 26 may be adjusted proportionately; moreover, the invention is adapted for use with sewing machines that are powered by a foot treadle or an electric motor, and to sewing machines for industrial use or home use. Clearly, any type of thread may be employed on the bobbin in accordance with the invention, whether natural or synthetic, and of many different gauges. Also, the reservoir for the lubricant need not be formed within the hub; it may be formed for example on the lower face of the lower bobbin flange and ruptured by interaction with a part of the sewing machine when the bobbin is inserted into the sewing machine and properly seated for use therein. The essential feature is that the reservoir be positioned relative to the bobbin in such a manner that when the bobbin is inserted into the sewing machine for use therein, the membrane is broken so that the lubricant contained in the reservoir drains out and lubricates the sewing machine. Accordingly, the invention is not limited except by the appended claims.

I claim:

1. A bobbin comprising:

a hollow hub for cooperating with a part for guiding the bobbin into place in a sewing machine and further for having thread wound therearound, the thread paying out for use in the sewing machine;

membrane means extending across the hub to form a reservoir within the hub; and a flowable lubricant contained within the reservoir;

whereby when the bobbin is inserted into the sewing machine for use therein the part punctures the membrane means and the lubricant contained in the reservoir drains out and lubricates the sewing machine.

2. A bobbin according to claim 1 further comprising a pair of flanges extending radially outwardly from the hub, the flanges being spaced apart from each other axially along the hub and facilitating neatly storing the thread wound around the hub.

3. A bobbin according to claim 2 wherein the membrane means comprises a pair of membranes applied to the bobbin respectively adjacent to the flanges.

4. A bobbin according to claim 2 wherein each of the membranes is made of plastic.

5. A bobbin according to claim 3 wherein each of the membranes is secured to the bobbin by an adhesive.

6. A bobbin according to claim 3 wherein the part punctures only one of the membranes when the bobbin is inserted into the sewing machine.

7. A bobbin according to claim 3 wherein the part punctures both of the membranes when the bobbin is inserted into the sewing machine.

8. A bobbin according to claim 1 wherein the flowable lubricant comprises a sewing machine oil.

9. A bobbin for use in a sewing machine, the bobbin comprising:

a hub;

a pair of flanges spaced part from each other axially along the hub and extending radially outwardly therefrom;

membrane means connected to the bobbin to form a reservoir; and a flowable lubricant contained within the reservoir;

whereby, when the bobbin is inserted into the sewing machine for use therein, the membrane means is ruptured so that the lubricant contained in the reservoir drains out and lubricates the sewing machine.

10. A method of automatically lubricating a sewing machine comprising the steps of:

adding a reservoir formed at least in part of a breakable membrane to a bobbin that supplies a predetermined quantity of bobbin thread for use in the sewing machine; and adding to the reservoir a quantity of flowable lubricant proportioned to the predetermined quantity of bobbin thread;

wherein the reservoir is positioned relative to the bobbin in such a manner that the bobbin cannot be inserted into the sewing machine for use therein without breaking the membrane;

whereby, when the bobbin is inserted into the sewing machine for use therein, the membrane is broken and a predetermined quantity of lubricant proportioned to the predetermined quantity of bobbin thread flows out of the reservoir to lubricate the sewing machine.

11. A method of automatically lubricating a sewing machine in a manner proportioned to the usage of the sewing machine, the method comprising the steps of:

providing a plurality of bobbins for successive use in the sewing machine, each of the bobbins containing a predetermined quantity of bobbin thread for use in the sewing machine;

adding to each bobbin a reservoir formed at least in part of a breakable membrane; and adding to each reservoir a quantity of flowable lubricant proportioned to the predetermined quantity o bobbin thread contained on the bobbin to which such reservoir is added;

wherein each reservoir is positioned relative to its bobbin in such a manner that the bobbin cannot be inserted into the sewing machine without breaking the membrane;

whereby, when each bobbin is inserted into the sewing machine for use therein, its membrane is broken and a quantity of lubricant proportioned to the predetermined quantity of bobbin thread contained on the bobbin flows out of the reservoir to lubricate the sewing machine; and whereby the heavier the usage of the sewing machine, the more quickly the thread on each bobbin is used up, the more frequently the bobbins are changed, and the more frequently the sewing machine is lubricated.

12. A method according to claim 11 wherein the predetermined quantity of bobbin thread on one of the plurality of bobbins is the same as the predetermined quantity of bobbin thread on another of the plurality of bobbins.

13. A method according to claim 11 wherein the predetermined quantity of bobbin thread on one of the plurality of bobbins is different from the predetermined quantity of bobbin thread on another of the plurality of bobbins.

* * * * *